US008267640B1

(12) United States Patent
Lin et al.

(10) Patent No.: US 8,267,640 B1
(45) Date of Patent: Sep. 18, 2012

(54) TURBINE PUMP WITH FLOATING RACEWAY

(75) Inventors: Chih Lin, Tipp City, OH (US); William J. Watkins, Tipp, OH (US)

(73) Assignee: Crane Pumps & Systems, Inc, Piqua, OH (US)

( * ) Notice: Subject to any disclaimer, the term of this patent is extended or adjusted under 35 U.S.C. 154(b) by 407 days.

(21) Appl. No.: 12/472,794

(22) Filed: May 27, 2009

Related U.S. Application Data

(60) Provisional application No. 61/056,322, filed on May 27, 2008.

(51) Int. Cl.
*F04D 1/00* (2006.01)

(52) U.S. Cl. ..... 415/55.1

(58) Field of Classification Search ..... 415/55.1, 415/104, 172.1, 174.3, 196, 55.2–55.7, 127, 415/128, 173.3, 174.2, 229, 231; 277/379
See application file for complete search history.

(56) References Cited

U.S. PATENT DOCUMENTS

2006/0104804 A1* 5/2006 Yu et al. ..... 415/55.1
2007/0231121 A1* 10/2007 Baecke et al. ..... 415/55.1

* cited by examiner

*Primary Examiner* — Edward Look
*Assistant Examiner* — Christopher R Legendre
(74) *Attorney, Agent, or Firm* — Standley Law Group LLP

(57) ABSTRACT

A turbine pump that permits an impeller to stay compliant with a raceway by the use of a preloaded floating raceway that operates by utilizing fluid floating on both side of the raceway within the pump. Exemplary embodiments of the pump include a mounting frame that is adapted to engage the pump to a drive source; an end frame that is adapted to attach to the mounting frame and includes an inlet section and an outlet section that facilitate fluid flow entering and exiting the pump; a motor shaft enclosed within the mounting frame; a floating raceway that is situated within the end frame and positioned around the distal end of the motor shaft, and includes an inlet passage, an outlet passage and a bypass hole fixed relative to the position of the inlet passage and the outlet passage; a spring located at the top of the floating raceway and at least partially contained within a corresponding cavity located in the end frame that is preloaded to help maintain a desired clearance between the floating raceway and the impeller; and an impeller secured to an distal end of the motor shaft.

17 Claims, 5 Drawing Sheets

SECTION A-A

TURBINE PUMP WITH FLOATING RACEWAY

CROSS-REFERENCE TO RELATED APPLICATIONS

This application is a non-provisional of U.S. provisional patent application 61/056,322, filed May 27, 2008, which is incorporated by reference as if fully recited herein.

TECHNICAL FIELD

The present invention relates to pumps and, more particularly, to a regenerative turbine pump with a floating raceway.

BACKGROUND OF THE ART

Many different types of pumps, in particular, regenerative turbine pumps, have the capability to deliver fluid from one location to another. Typically, a pump moves fluids from lower pressure to higher pressure, and overcomes this difference in pressure by adding energy to the system. Normally, regenerative turbine pumps add energy to the system by adding centrifugal force and shearing action to the fluid.

Generally, a regenerative turbine pump includes an impeller that has a multiplicity of impeller vanes in series. Unlike many other types of fluid pumps, in a regenerative turbine pump, fluid travels through the impeller more than once by completing multiple revolutions through the vanes. The multiple revolutions of the fluid through the impeller vanes impart a centrifugal force outward to the impeller periphery. Preferably, the centrifugal force creates an orderly circulatory flow of fluid that is imposed by the impeller vanes and creates fluid velocity. The fluid velocity may be turned into kinetic energy that in turn is available to increase the flow velocity and/or pressure of the fluid, depending upon the characteristics desired when the fluid exits the pump. Each time the fluid travels through the impeller vanes, the fluid acquires more kinetic energy which may be converted into increased flow velocity and/or fluid pressure.

Many times, regenerative turbine pumps are used in applications that have high head pressure and low fluid flow characteristics. Generally, in situations with very high head pressure and low fluid flow, the pump is susceptible to leakage. Therefore, very tight internal tolerances and parallelism are typically required between the impeller and raceway to reduce the leakage within the pump.

Some regenerative turbine pumps do not have any adjustable features used in parallel with a selected-fit between the impeller and a fixed raceway to achieve and maintain the tight tolerances required for adequate performance of the pump. Generally, the raceway conducts fluid into the impeller, and then provides a channel for the liquid to move in as it is propelled and energized by the impeller. However, after use in the field, the impeller and/or the raceway may gradually wear due to frictional fluid flow and increase the clearance between the impeller and the raceway. Consequently, the pump will lose its performance capability and a costly and time-consuming adjustment of the pump clearances is required to regain optimal performance characteristics of the pump.

What is needed is a pump that does not require field adjustment of the pump clearances after installation to maintain desired tolerances between the impeller and raceway. Also, a pump is desired which provides an inexpensive means to eliminate the costly selected fit of the impeller with the raceway. Furthermore, a pump is coveted which is compliant and is self-adjusting.

SUMMARY OF THE INVENTION

In contrast to known means of maintaining the tight tolerances required for adequate performance in a regenerative turbine pump which, for example, may require the adjustment of the pump clearances, one embodiment of the pump permits the impeller to stay compliant with the raceway by the use of a preloaded floating raceway that operates by utilizing fluid floating on both sides of the raceway within the pump. One principal advantage of this device is that there is no longer a need to adjust the pump clearances to realign the impeller within the raceway to maintain desired tolerances required for adequate performance of the pump. An additional advantage of exemplary embodiments of the pump may include reducing the maintenance costs by eliminating the need to adjust the pump clearances. Furthermore, some exemplary embodiments may reduce manufacturing costs by reducing the need for a selected fit of the impeller with the raceway. Additionally, exemplary embodiments may reduce wear on the raceway and/or the impeller, the amount of starting torque required, and the pressure loss due to defective tolerances between the raceway and the impeller. Exemplary embodiments may simplify field repair by reducing the number of components to replace—typically, the wear ring is the only component to be replaced. Also, exemplary embodiments may improve pump performance by reducing pressure loss within the pump.

One object of exemplary embodiments of the pump is to eliminate the need to adjust the pump clearances of regenerative turbine pumps to desired clearance tolerances between the impeller and the raceway to regain desired performance characteristics.

Another object of exemplary embodiments of the pump is to reduce the cost to manufacture regenerative turbine pumps by reducing the need for selected fit of the impeller with the raceway.

An exemplary embodiment of a turbine pump may include a mounting frame that is adapted to engage the pump to a drive source, an end frame that is adapted to attach to the mounting frame and includes an inlet section and an outlet section that facilitate fluid flow entering and exiting the pump, and a motor shaft enclosed within the mounting frame. Exemplary embodiments may also include a floating raceway that is situated within the end frame and positioned around the distal end of the motor shaft. The floating raceway may include an inlet passage, an outlet passage and a bypass hole fixed relative to the position of the inlet passage and the outlet passage. A spring located at the top of the floating raceway and at least partially contained within a corresponding cavity located in the end frame that is preloaded to help maintain a desired clearance between the floating raceway and the impeller in exemplary embodiments of the pump. Exemplary embodiments may include an impeller including a plurality of vanes on both the first and second faces that is secured to a distal end of the motor shaft by a press fit and a set screw. Also, exemplary embodiments may include a locking nut secured to the distal end of the motor shaft that assists in axially securing the impeller thereon. Exemplary embodiments may include a wear member interposed between a proximal face of the floating raceway and a first face of the impeller.

Exemplary embodiments may include one or more gaskets. A frame gasket interposed between complimentary faces of the mounting frame and the end frame may be included in exemplary embodiments. Also, an inlet gasket may be interposed between the inner face of the inlet section and the outer face of the outlet passage. Likewise, exemplary embodiments may include a medial gasket interposed between the inner face of the end frame and an outside edge of the floating raceway. Furthermore, exemplary embodiments may include an outlet gasket interposed between an inner face of the outlet section and the outer face of the outlet passage.

While certain embodiments of the pump are described in detail herein, the scope of exemplary embodiments is not to be considered limited by such disclosure, and modifications are possible without departing from the spirit of the invention.

BRIEF DESCRIPTION OF THE DRAWINGS

Other aspects of the present invention will be readily apparent from the following descriptions of the drawings and exemplary embodiments, wherein identical reference numerals refer to identical parts, and wherein.

DETAILED DESCRIPTION OF THE EXEMPLARY EMBODIMENTS

Some sample embodiments of the pump will now be described in greater detail. Nevertheless, it should be recognized that exemplary embodiments of the pump can be practiced in a wide range of other embodiments besides those explicitly described, and the scope of the exemplary embodiments of the pump is expressly not limited except as specified in any accompanying claims. Specifically, although the pump may be described as operating substantially vertically, exemplary embodiments of the pump may operate substantially horizontally or at angles therebetween.

Figure 1:
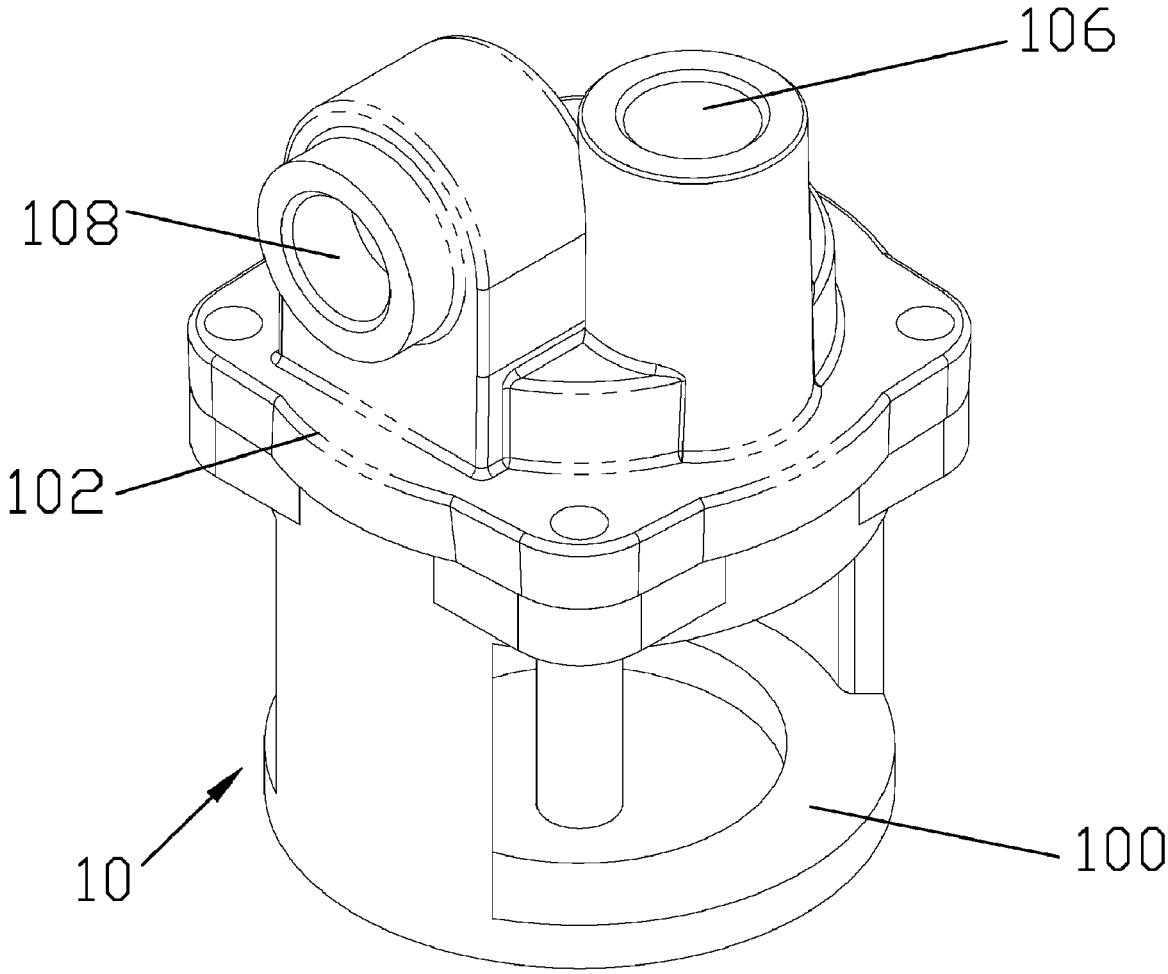
FIG. 1 is a perspective view of an exemplary embodiment of a regenerative turbine pump having a floating raceway.
Figure 2:
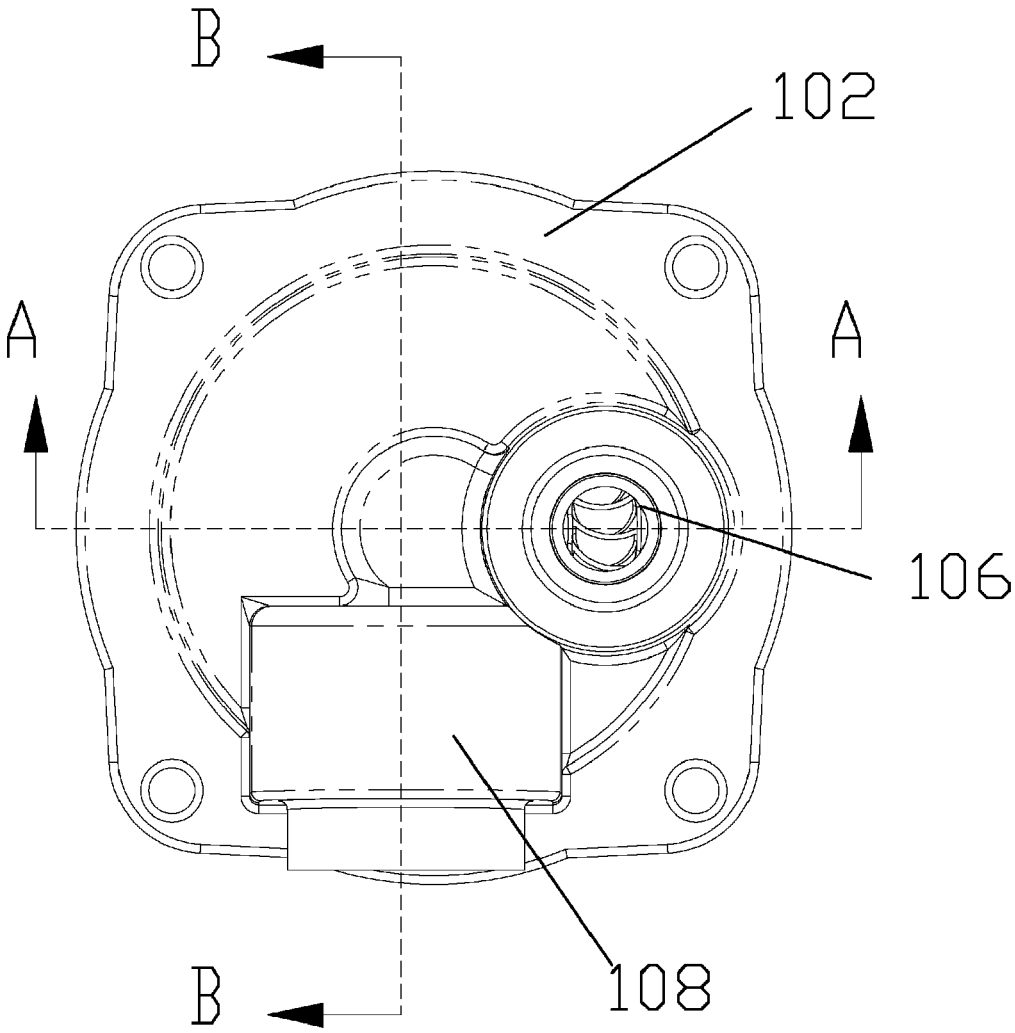
FIG. 2 is a top plan view of the FIG. 1 embodiment.

FIG. 1 illustrates one exemplary embodiment of the regenerative turbine pump 10. As seen, this particular embodiment of the pump 10 includes a mounting frame 100 that is adapted to engage and/or affix the pump 10 to a drive source or other desired member. Additionally, the pump 10 may include an end frame 102 that is adapted to attach to the mounting frame 100. Depending on the materials used to construct the mounting frame 100 and the end frame 102, and or other design or operational factors, one skilled in the art would understand that the end frame 102 may be attached to the mounting frame 100 by any number of connecting means, such as, but not limited to: threaded fasteners, welding, clamping, nailing, pinning, riveting, screwing, latching, etc.

The end frame 102 has an inlet section 106 and an outlet section 108 that facilitate fluid flow entering and exiting the pump 10. Preferably, fluid enters the inlet section 106 and exits the outlet section 108 during operation of the pump 10. However, in some exemplary embodiments, the fluid flow of the pump 10 may be reversible, as the fluid may enter the outlet section 108 and exit the inlet section 106.

In one embodiment, the inlet section 106 and outlet section 108 are integral with the end frame 102, such as by molding, casting or other manufacturing techniques. However, in other embodiments, depending on the materials used to construct a pump 10, and/or other design or operational factors, one skilled in the art would understand that the inlet section 106 and/or outlet section 108 may be separate components from the end frame 102 that may be attached to the end frame 102 by any number of fastening means, such as, but limited to: various threaded fasteners, adhesives, welds, etc.

Referring to FIGS. 2 through 5, the rest of the major components of the pump 10 are shown. Preferably, in operation, the fluid would enter the pump 10 through the inlet section 106. After passing through the inlet section 106, the fluid flows through an inlet passage 110 of a floating raceway 112. Subsequently, the fluid flows into an impeller 114 wherein the pressure of the fluid is raised. Depending upon the desired characteristics of the pump system, any number of combinations of motor size, shut-off head and maximum flow may be used, as would be understood by one skilled in the art. In this particular embodiment, the pump 10 is provided as a single stage pump. However, in other exemplary embodiments, the pump 10 may have more than one pumping stage.

Figure 3:
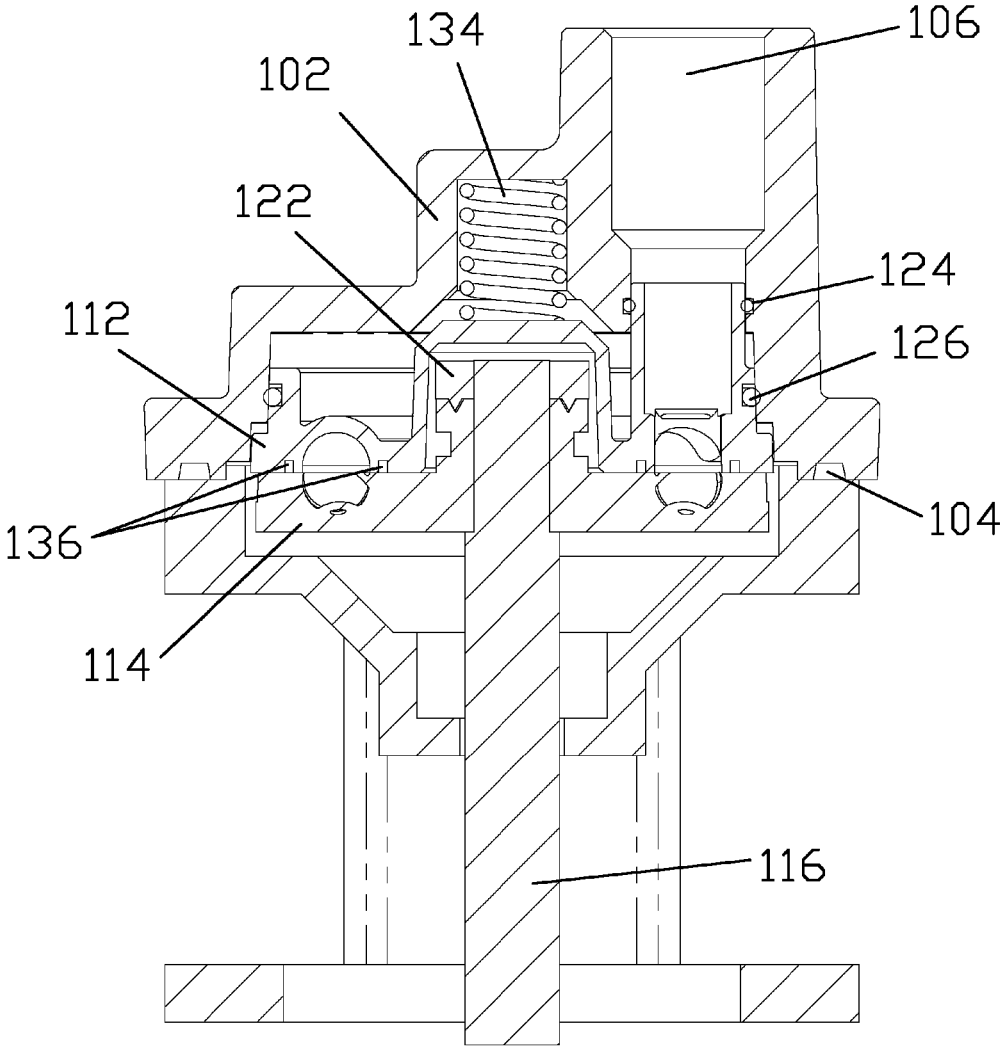
FIG. 3 is a sectional elevation view taken along line A-A of FIG. 2.
Figure 4:
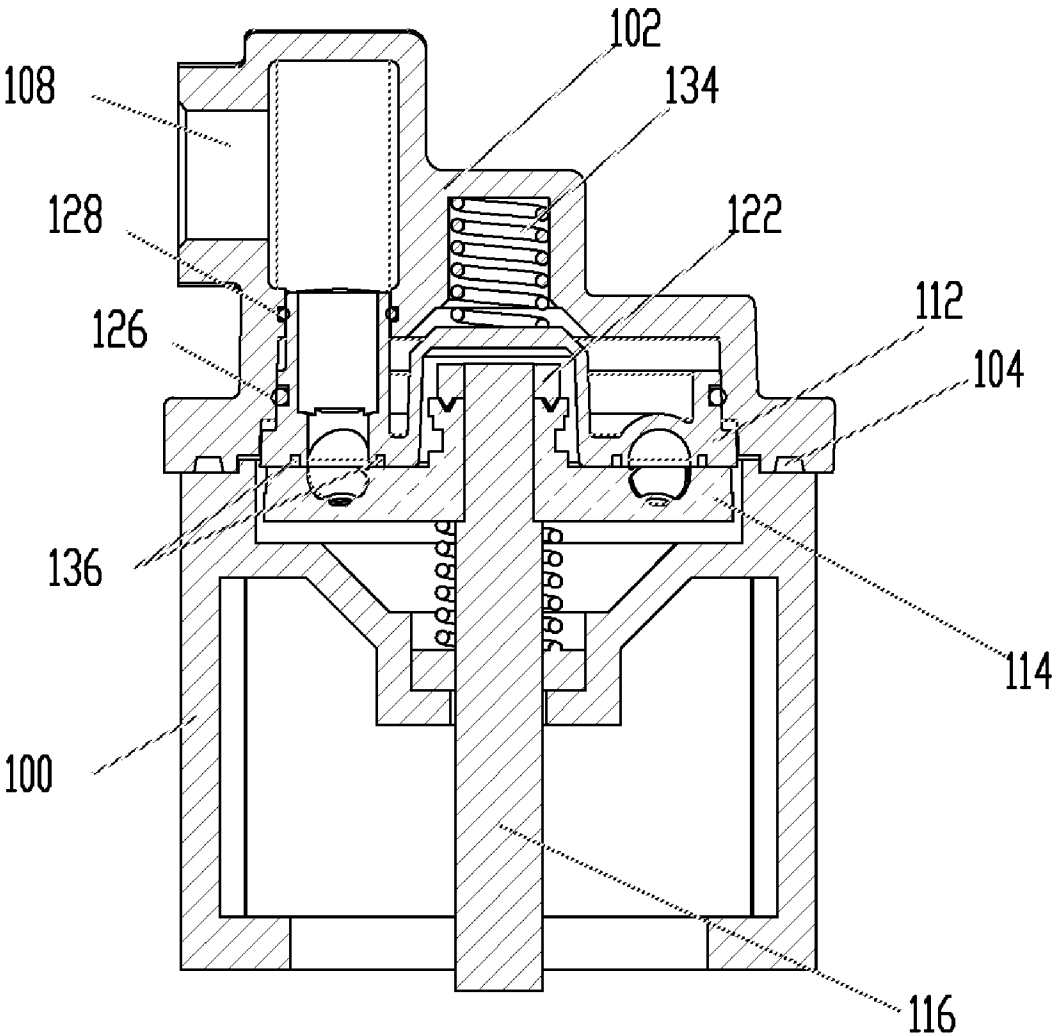
FIG. 4 is a sectional elevation view taken along line B-B of FIG. 2.

As seen in FIGS. 1, 3 and 4, in one embodiment, the distal end of the motor shaft 116 is enclosed within a mounting frame 100 by a means for fastening. In this particular embodiment, the impeller 114 is secured to the distal end of the motor shaft 116 by a press fit, wherein at least a portion of the ID of the impeller 114 is adapted to engage at least a portion of the OD of the motor shaft 116. In another embodiment, the impeller 114 may be key driven on the motor shaft 116, where a key assists securing the impeller 114 to the motor shaft 116. In another particular embodiment, a set screw may help secure the impeller 114 to the motor shaft 116. In additional embodiments, the impeller 114 may be secured to the motor shaft 116 by any other number of securing means, depending upon design factors and other characteristics, as would be understood by one skilled in the art. Additionally, a locking nut 122 secures to the distal end of the motor shaft 116 and assists in axially securing the impeller 114. At least a portion of the locking nut 122 engages at least a portion of the impeller 114. In this particular embodiment, the locking nut 122 is threaded onto the motor shaft 116. However, in other embodiments, the locking nut 122 may be secured to the motor shaft 116 by any other securing means. In exemplary embodiments, the impeller 114 is a turbine impeller that may include a plurality of vanes located on only one face of the impeller 114. However, in other embodiments, the impeller 114 is an impeller that has a plurality of vanes, respectively, on each face of the impeller 114.

Figure 5:
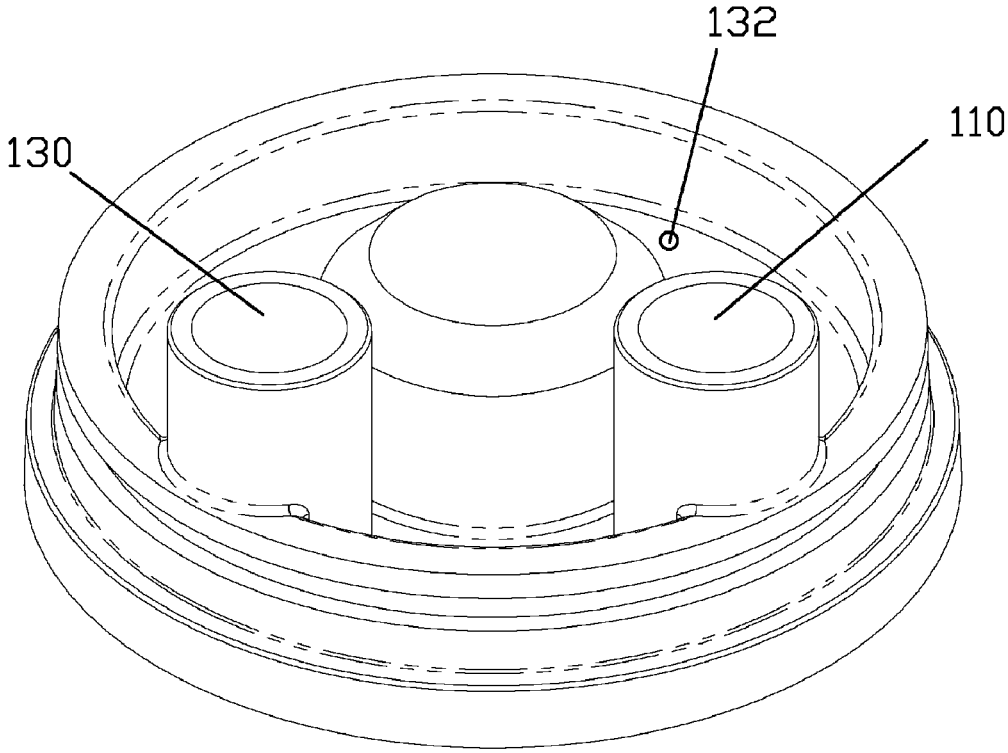
FIG. 5 is a perspective view of the floating raceway, taken in isolation from the regenerative turbine pump.

Referring to FIGS. 3 through 5, situated within the end frame 102 and positioned around the distal end of the motor shaft 116 is a floating raceway 112. In one embodiment, a gap between the floating raceway 112 and the corresponding inner face of the end frame 102 is sealed by at least one gasket. Preferably, the gap between the floating raceway 112 and the corresponding inner face of the end frame 102 is sealed by three different gaskets: an inlet gasket 124, a medial gasket 126 and an outlet gasket 128. Typically, the inlet gasket 124 is interposed between the inner face of the inlet section 106 and the outer face of an inlet passage 110 that projects from the top face of the floating raceway 112. Likewise, the medial gasket 126 is interposed between the inner face of the end frame 102 and an outside edge of the floating raceway 112. Similarly, the outlet gasket 128 is interposed between an inner face of the outlet section 108 and the outer face of an outlet passage 130 that projects from the top face of the floating raceway 112.

Preferably, during operation of the pump 10, the clearance between the proximal face of the floating raceway 112 and the top face of the impeller 114 is negligible to facilitate the growth of kinetic energy that may lead to higher pressure within the fluid exiting the pump 10. Furthermore, the floating raceway 112 includes a bypass hole 132 that extends through the floating raceway 112, as seen in FIG. 5. Typically, the bypass hole 132 is fixed relative to the position of the inlet passage 110 and the outlet passage 130. Preferably, the bypass hole 132 substantially balances the hydraulic net force exerted against both the distal and proximal faces of the floating raceway 112. Therefore, the backside pressure within the pump 10 ideally maintains the same ratio with the discharge pressure. Accordingly, the floating raceway 112 may stay compliant within a desirable clearance of the physical position of the impeller 114. As a result, the bypass hole 132 should alleviate the expensive adjustment of the motor shaft device found in numerous other regenerative turbine pumps that use a fixed raceway.

Referring again to FIGS. 3 and 4, at the top of the floating raceway 112 is a spring 134. The spring 134 is at least partially contained within a corresponding cavity located in the end frame 102. Preferably, the cavity limits the upward vertical and the horizontal displacement of the spring 134. The spring 134 aids in limiting the upward vertical displacement of the floating raceway 112. Additionally, the spring 134 is preloaded so it may help maintain a desired clearance between the floating raceway 112 and the impeller 114, especially during the crucial start-up phase of the pump 10.

To help minimize the wear of the floating raceway 112 during operation of the pump 10, preferably, the floating raceway 112 gently engages the impeller 114 from the net force of the spring 134, net hydraulic force, and/or the friction of the gaskets. It is preferred that the gap between the floating raceway 112 and the impeller 114 is small enough to allow the kinetic energy desired to formulate within the fluid during the fluid flow within the impeller 114 vanes. Any contact between the floating raceway 112 and the impeller 114 should be insufficient enough to cause significant wear between the floating raceway 112 and the impeller 114 to minimize the need to replace those components.

Preferably, in one embodiment, a frame gasket 104 is interposed between the complimentary faces of the mounting frame 100 and the end frame 102. The frame gasket 104 may aid in preventing fluid leakage between the mounting frame 100 and the end frame 102.

It is preferred, but is not required, that the pump 10 contains at least one wear member 136 interposed between the proximal face of the floating raceway 112 and the first face of the impeller 114. Additionally, the proximal face of the floating raceway 112 may have a groove corresponding to the shape of each wear member 136. Each groove may at least partially contain the corresponding wear member 136 within the groove and limit the physical displacement of the wear member 136 relative to the floating raceway 112 and the impeller 114. The wear member 136 assists with maintaining a desired clearance between the floating raceway 112 and the impeller 114.

What is claimed is:

1. A turbine pump comprising:
- a mounting frame that is adapted to engage the pump to a drive source;
- an end frame that is adapted to attach to the mounting frame and comprising:
  - an inlet section; and
  - an outlet section, each of which facilitates fluid flow through the pump;
- a motor shaft enclosed within the mounting frame and having a distal end;
- a floating raceway that is situated within the end frame and positioned around the distal end of the motor shaft, and comprising:
  - an inlet passage;
  - an outlet passage; and
  - a bypass hole, fixed relative to the position of the inlet passage and the outlet passage;
- an impeller secured to the distal end of the motor shaft;
- a spring, arranged in the end frame and at least partially contained within a corresponding cavity located in the end frame, the spring being preloaded and positioned to help maintain a desired clearance between the floating raceway and the impeller.

2. The pump of claim 1, further comprising:
- a locking nut, secured to the distal end of the motor shaft, to assist in axially securing the impeller.

3. The pump of claim 1, further comprising:
- an inlet gasket, interposed between an inner face of the inlet section and an outer face of the inlet passage.

4. The pump of claim 1, further comprising:
- a medial gasket, interposed between an inner face of the end frame and an outside edge of the floating raceway.

5. The pump of claim 1, further comprising:
- an outlet gasket, interposed between an inner face of the outlet section and an outer face of the outlet passage.

6. The pump of claim 1, further comprising a frame gasket interposed between complimentary faces of the mounting frame and the end frame.

7. The pump of claim 1, further comprising a wear member interposed between a proximal face of the floating raceway and a first face of the impeller.

8. The pump of claim 1, wherein the impeller is secured to the distal end of the motor shaft by a press fit.

9. The pump of claim 1, wherein the impeller is key driven to the distal end of the motor shaft.

10. The pump of claim 1, wherein a set screw secures the impeller to the motor shaft.

11. A turbine pump comprising:
- a mounting frame that is adapted to engage the pump to a drive source;
- an end frame that is adapted to attach to the mounting frame, comprising an inlet section and an outlet section that facilitate fluid flow entering and exiting the pump;
- a motor shaft enclosed within the mounting frame and having a distal end;
- a floating raceway that is situated within the end frame and positioned around the distal end of the motor shaft, the floating raceway comprising:
  - an inlet passage;
  - an outlet passage; and
  - a bypass hole fixed relative to the position of the inlet passage and the outlet passage;
- an impeller that is secured to the distal end of the motor shaft by a press fit;
- a spring positioned in the end frame and at least partially contained within a corresponding cavity located in the end frame, the spring being preloaded to help maintain a desired clearance between the floating raceway and the impeller;
- a locking nut secured to the distal end of the motor shaft that assists in axially securing the impeller thereon;
- a frame gasket interposed between complimentary faces of the mounting frame and the end frame; and
- a wear member interposed between a proximal face of the floating raceway and a first face of the impeller.

12. The pump of claim 11, further comprising:
- an inlet gasket interposed between an inner face of the inlet section and an outer face of the inlet passage.

13. The pump of claim 11, further comprising:
- a medial gasket, interposed between an inner face of the end frame and an outside edge of the floating raceway.

14. The pump of claim 11, further comprising:

an outlet gasket, interposed between an inner face of the outlet section and an outer face of the outlet passage.

15. The pump of claim 11, wherein the impeller is key driven to the distal end of the motor shaft.

16. The pump of claim 11, wherein a set screw secures the impeller to the motor shaft.

17. A turbine pump comprising:

a mounting frame that is adapted to engage the pump to a drive source;

an end frame that is adapted to attach to the mounting frame and includes an inlet section and an outlet section that facilitate fluid flow through the pump;

a motor shaft enclosed within the mounting frame and having a distal end;

a floating raceway that is situated within the end frame and positioned around the distal end of the motor shaft, and includes an inlet passage, an outlet passage and a bypass hole fixed relative to the position of the inlet passage and the outlet passage;

an impeller, secured to a distal end of the motor shaft by a press fit and a set screw;

a spring, arranged in the end frame and at least partially contained within a corresponding cavity located in the end frame that is preloaded to help maintain a desired clearance between the floating raceway and the impeller;

a locking nut secured to the distal end of the motor shaft that assists in axially securing the impeller thereon;

a frame gasket interposed between complimentary faces of the mounting frame and the end frame;

a wear member interposed between a proximal face of the floating raceway and a first face of the impeller;

an inlet gasket interposed between an inner face of the inlet section and an outer face of the outlet passage;

a medial gasket interposed between an inner face of the end frame and an outside edge of the floating raceway; and an outlet gasket interposed between an inner face of the outlet section and an outer face of the outlet passage.

* * * * *